US006098380A

United States Patent [19]

Goodwin et al.

[11] Patent Number: 6,098,380

[45] **Date of Patent: *Aug. 8, 2000**

[54] WEB SHAPING METHOD AND MEANS

[75] Inventors: James Goodwin; James Robert Stembridge, both of Coventry, United Kingdom

[73] Assignee: Lipton, division of Conopco, Inc., Englewood Cliffs, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/997,017

[22] Filed: Dec. 23, 1997

[30] Foreign Application Priority Data

Dec. 23, 1996 [EP] European Pat. Off. ..... 96309458

[51] Int. Cl.[7] ..... B65B 9/22; B65B 29/04

[52] U.S. Cl. ..... 53/451; 53/551; 53/552

[58] Field of Search ..... 53/550, 552, 551, 53/451, 553, 554, 555, 450, 413; 493/302

[56] References Cited

U.S. PATENT DOCUMENTS

| | | | |
|---|---|---|---|
| 2,113,658 | 4/1938 | Lakso . | |
| 2,272,530 | 2/1942 | Patterson | 53/451 |
| 2,334,256 | 11/1943 | Eaton | 53/451 |
| 2,361,052 | 10/1944 | Patterson | 53/451 |
| 2,385,229 | 9/1945 | Patterson | 53/451 |
| 2,385,897 | 10/1945 | Waters | 53/551 |
| 2,447,014 | 8/1948 | Irmscher | 53/450 |
| 2,533,554 | 12/1950 | Byerly . | |
| 2,718,915 | 9/1955 | Piazze . | |
| 2,934,130 | 4/1960 | Lane et al. . | |
| 2,966,021 | 12/1960 | Lane et al. . | |
| 3,045,404 | 7/1962 | Wilson . | |
| 3,092,248 | 6/1963 | Lane et al. . | |
| 3,127,819 | 4/1964 | Woolsey . | |
| 3,412,656 | 11/1968 | Corneliusson . | |
| 3,482,491 | 12/1969 | Gustafson . | |
| 3,526,079 | 9/1970 | Maxeiner et al. | 493/302 |
| 4,067,170 | 1/1978 | Yates, Jr. . | |
| 4,107,900 | 8/1978 | Izumi | 53/555 |
| 4,191,438 | 3/1980 | Schmachtel | 493/302 |
| 4,235,064 | 11/1980 | Wenger | 53/451 |
| 4,417,433 | 11/1983 | Mitchell . | |
| 4,442,656 | 4/1984 | Wylie, Sr. | 53/552 |
| 4,517,790 | 5/1985 | Kreager | 53/552 |
| 4,524,567 | 6/1985 | Patelli . | |
| 4,563,231 | 1/1986 | Porrmann et al. | 53/451 |
| 4,589,145 | 5/1986 | Van Ereden et al. | 53/550 |
| 4,604,854 | 8/1986 | Andreas | 53/552 |
| 4,620,409 | 11/1986 | McElvy | 53/551 |

(List continued on next page.)

FOREIGN PATENT DOCUMENTS

| | | |
|---|---|---|
| 0 023 128 | 1/1981 | European Pat. Off. . |
| 0273507 | 7/1988 | European Pat. Off. . |
| 19539888 | 10/1996 | Germany . |
| 55-3205 | 1/1980 | Japan . |
| 994941 | 6/1965 | United Kingdom . |
| 1161014 | 8/1969 | United Kingdom . |
| 2319326 | 5/1998 | United Kingdom . |
| 92/14649 | 9/1992 | WIPO . |
| 95/01907 | 1/1995 | WIPO . |

OTHER PUBLICATIONS

English language translation of the description of the drawings, col. 2–line 36 to col. 4, line 27 of Japanese 55–3205.

*Primary Examiner*—Stephen F. Gerrity
*Attorney, Agent, or Firm*—James J. Farrell

[57] ABSTRACT

The formation of a tubular web in a form-fill process is achieved by drawing the web along a tapering guide (6) and then along a forming tube (20) the axis of which is at a small angle to the guide plate and intersects the guide. The web is drawn along the guide and tube by opposed drive rollers (24) at a station along the length of the forming tube, the rollers gripping the edges of the web together. The side margins of the web are folded over from a central portion when the web travels along the guide plate but the side edges are brought together only after they reach the forming tube. The drive rollers (24) or sealing rollers (26) further along the forming tube seal the edges together to form a closed tube.

43 Claims, 4 Drawing Sheets

U.S. PATENT DOCUMENTS

| | | | |
|---|---|---|---|
| 4,745,731 | 5/1988 | Talbott et al. | 53/551 |
| 4,807,426 | 2/1989 | Smith . | |
| 4,876,842 | 10/1989 | Ausnit | 53/550 |
| 4,986,054 | 1/1991 | McMahon . | |
| 4,991,379 | 2/1991 | Boeckmann . | |
| 5,072,571 | 12/1991 | Boeckmann | 53/553 |
| 5,425,216 | 6/1995 | Ausnit | 53/451 |
| 5,548,947 | 8/1996 | Fincham et al. | 53/551 |
| 5,832,701 | 11/1998 | Hauers et al. | 53/451 |

WEB SHAPING METHOD AND MEANS

BACKGROUND OF THE INVENTION

This invention relates to the production of packets of material in a form-fill process. It is particularly concerned with a method and means for shaping a web of the packet material into a tubular form in a form-fill process, but also with packets produced by a form-fill process and provided with a tag.

DESCRIPTION OF THE RELATED ART

The known form-fill process employs a continuous web of flexible packet material which is drawn along the exterior of a forming tube to assume the cross-sectional shape of the tube. While on the tube, the side margins of the web are sealed together, and the filler material is fed through the tube into compartmented spaces of the tubular web as those spaces are sealed from each other after the web has run off the forming tube. Examples of this process can be seen in, for instance, U.S. Pat. No. 3,045,404, 4,067,170, 4,524,567 and 4,986,054.

The formation of the web to its tubular shape generally requires the use of fixed guide elements over which the web slides as it moves onto the forming tube. To effect the change of shape in a reliable manner, in particular if the compartmented spaces are to be loosely filled with a dry particulate material which does not assist the shaping of the tube, the guide elements are required to bear on the face of the web that forms or is to form the exterior of the tube. If the finished packets are to have external attachments that may snag on these guide elements, the tube must first be formed before the attachments can be fixed to the web material. Because of the nature of the form-fill process it is then not practical to fix the attachments in place until after the filler material has been inserted, which complicates the task and can limit the rate of operation.

It has been proposed in U.S. Pat. No. 2,934,130 to draw a web along a downwardly inclined guide which provides a tapering track for the web so that progressively wider side margins overlap the guide. These side margins are folded over, with the aid of guiding rollers near the exit end of the fixed guide, to give the web a generally triangular, closed cross-sectional shape. A seam sealing assembly below the guide plate comprises heated metal bands that seal the side edges together and the tubular web then slides through an oblong shaped ring which folds the welded seam against the main body of the tubular web. Thus, this earlier apparatus also requires sliding contact with extensive regions of the exterior of the web. Furthermore, because the tubular formation of the web is completed on the inclined guide, access to the interior of the tubular web for the filling process is restricted. If, as described in U.S. Pat. No. 2,934,130, the tube is filled with liquid that may not be important but it can make the apparatus unsuitable for many other applications, eg. if dosing devices or other mechanisms are to be operated within the confines of the web.

BRIEF SUMMARY OF THE INVENTION

In one of its aspects the present invention provides apparatus for shaping a travelling web into a tubular form in a form-fill process, comprising a fixed guide for the web, said guide defining a track for the web tapering in the direction of web travel, a forming tube extending beyond the exit end of the guide in the direction of web travel, said tube having a longitudinal axis oblique to the guide and intersecting the guide track, means placing the web under tension to fold over the side margins of the web overlapping the side edges of the tapering guide track as the web travels along the guide so that the web transferring from the guide to the forming tube has an open tubular form, said means for placing the web under tension comprising traction elements adjacent the forming tube for gripping said edges as they travel along the tube with the web a closed tubular form, said traction elements being driven to draw the web along the guide and onto the forming tube.

In such an arrangement, the tension generated in the web by the traction elements, by virtue of the inclination of the guide relative to the form-fill tube, can be arranged to produce the forces that fold over the side margins as the web travels along the guide and tube. The external face of the web can be kept from rubbing contact with guide means over at least a substantial part of its width.

By closing the tubular cross-sectional form of the web only after it has transferred onto the form-fill tube, access to the tube is made easier if a drive is required to be transmitted to mechanisms within it such as a dosing valve.

To maintain the web essentially free of wrinkles, it may be desirable to provide gathering means disposed upstream of said traction elements for bringing opposed edges of said side margins together as the web travels along the forming tube. By arranging such gathering means ahead of the traction elements it is found possible to guide the web more stably, and in particular to reduce any tendency for wrinkles to form in the web. Preferably, also, at least one of the side margins is guided as it is folded over on the fixed guide before the web reaches the forming tube.

The angle of obliquity between the tube and the guide is preferably not substantially more than 35° and not substantially less than 8°. In general it will be desirable to choose an angle in the range 8° to 25°.

The traction elements conveniently take the form of a pair of drive rollers which grip the web edges between them without slippage. The rollers can serve solely for traction, and further elements such as another pair of rollers can be located downstream of them to seal the web side edges together, or the traction rollers can be adapted also to seal the web edges together.

Preferably, the traction rollers, and the sealing rollers where these are separate from the traction rollers, are inclined relative to the forming tube axis so that the driving force they apply to the web includes a component directed towards the tube. When separate sealing rollers are provided, they are preferably driven at a speed that maintains the web in tension between them and the traction rollers.

It is known to produce tea bags and other infusion packets with tag and thread attachments on the exterior of the packet and the present invention may be employed to produce such packets in which the tags and thread are attached to the web preceding a form-fill process in which the web is shaped and filled.

According to a further aspect of the invention, there is provided apparatus for shaping a travelling web into a tubular form in a form-fill process, comprising a fixed guide for the web, said guide defining a track for the web tapering in the direction of web travel, a forming tube downstream of the guide in the direction of web travel, said tube having a longitudinal axis oblique to the guide and intersecting the track of the web on the guide, traction means intermediate the length of the forming tube for drawing the web along the guide and forming tube and causing opposite side margins of the web overlapping the guide to fold over and converge towards each other as the web travels along the tapering guide, said traction means comprising opposed rolling elements for gripping opposite edges of said side margins together to be sealed so as to form the web into a closed tube with a longitudinal sealed seam, and means for laying said seam against an external wall of said tube and attaching it thereto.

When the web has been provided with tag and thread attachments for the packets to be formed, it is then possible to arrange that portions of the thread are so placed on the web that the laying of the seam against the web covers those portions and so traps them fast before use. In this way the risk of entangling the threads of the packets during subsequent handling and storage can be reduced.

The invention accordingly also includes a packet made of a heat sealable web material and having a seam along its length protruding from the main body of the packet, a tag and thread attachment secured to an external wall of said main body, said seam being laid against said external wall and temporarily secured thereto with a part of the length of the thread of said attachment sandwiched between the seam and said wall.

According to another aspect of the invention there is provided a method of shaping a travelling web into a tubular form in a vertical form-fill process, in which the web is drawn along a guide defining a track tapering in the direction of web movement, lateral margins of the web overlapping the side edges of the track being progressively folded over as the web travels along the guide to form the web into an open tubular shape in which the side edges of the web remain spaced apart, the open tubular shape web continuing its travel along a forming tube having a longitudinal axis oblique to the guide and intersecting the track of the web on the guide, the side edges of the web being brought together while travelling along the forming tube to close the tubular form of the web and being gripped between traction elements that draw the web along the guide and onto the forming tube, said side edges being sealed together while travelling along the forming tube.

BRIEF DESCRIPTION OF THE SEVERAL VIEWS OF THE DRAWING(S)

By way of example, the invention will be described in more detail with reference to the accompanying schematic drawings:

FIGS. 1 and 2 are mutually transverse axial views of apparatus according to the invention, FIG. 3 is a detail sectional view on the line III—III in FIG. 1, FIG. 4 is a diagram illustrating some leading dimensional relationships of the guide plate of the apparatus, FIG. 5 is a perspective view of the traction rollers and their drive in the apparatus of FIGS. 1–4, and FIG. 6 is a detail axial sectional view of the apparatus showing the filling material path and the form-fill tube in particular, FIG. 7 is a transverse section of the former tube on the line VII—VII in FIG. 6, and FIG. 8 shows a tagged tea bag that can be produced by the illustrated apparatus.

DETAILED DESCRIPTION OF THE INVENTION

Figure 1:
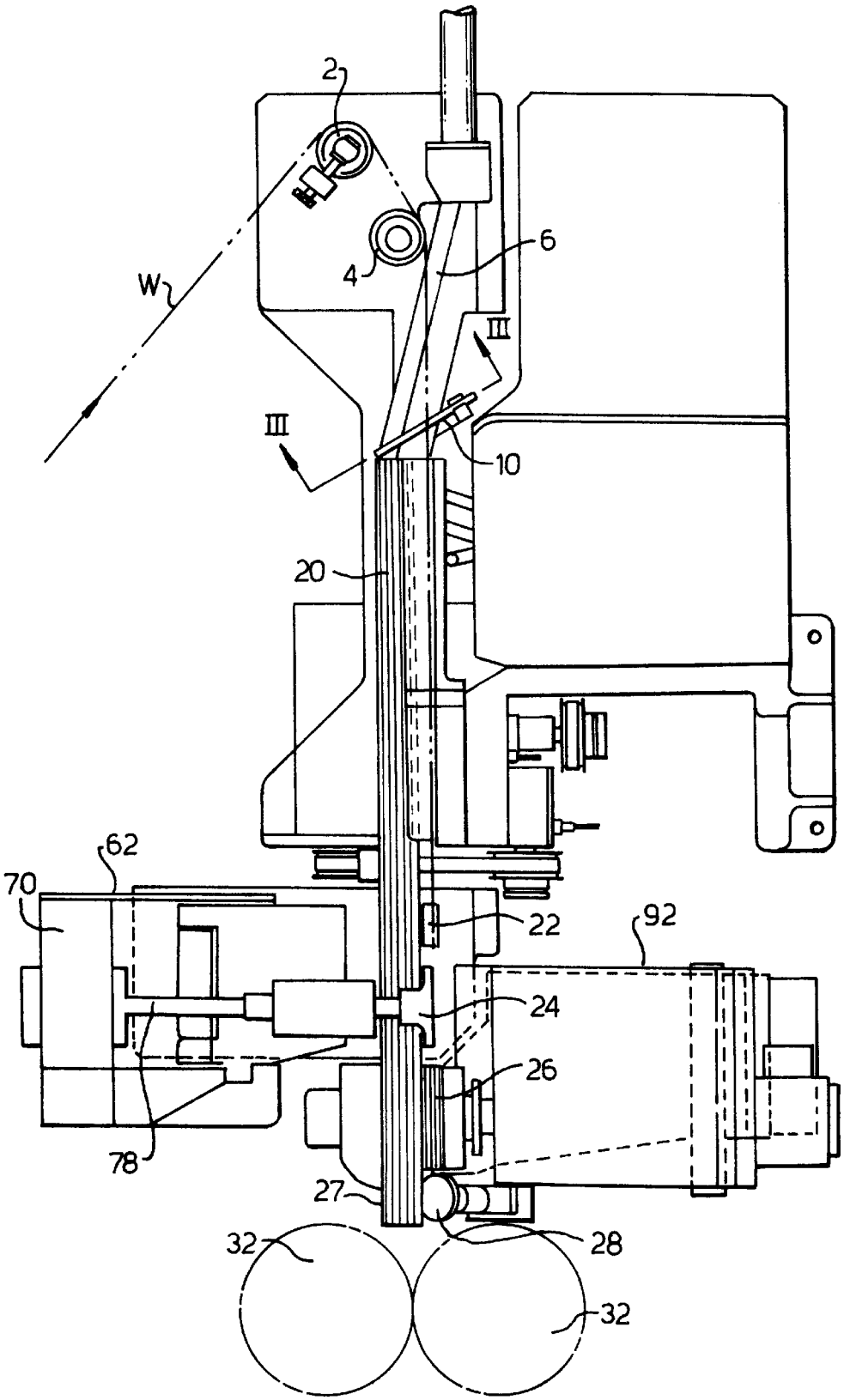

The drawings show a vertical form-fill process for producing filled and sealed packets in which a web W of the packet envelope material is continuously drawn downwards after passing over entry guide rolls 2,4 through successive stages of the form-fill process.

The initially flat web W runs from the entry guide rolls 2,4 onto a fixed guide 6. The guide 6 in this example is in the form of a plate having a planar main face 8, trapezoidal in shape, tapering downwards. The main face 8 of the plate contacted by the web is almost as wide as the web at its upper or leading end. As the web travels down the plate its side margins increasingly overlap the main face 8 and by virtue of the tension forces in the web, these side margins are folded over. Control of the folding over of the margins of the web may be assisted by auxiliary guides 10 near the exit end of the plate shown as rods, but which may incorporate idling rollers. The auxiliary guides are arranged close to side faces 12 of the plate but the side faces lie at a more acute angle to the face 8, as best seen in FIG. 3, so that the margins of the web are guided without rubbing against the side faces.

Immediately below the bottom of the plate is a forming tube 20 onto which the web W travels, past fixed guides 22 (FIG. 1) which bring the edges of the web side margins together some distance below the top of the form-fill tube. The web is drawn downwards along the guide 6 and form-fill tube 20 by traction elements, here shown as a pair of drive rollers 24 adjacent the tube and directly below the guides 22, which grip the edges of the web between them and draw the web down the guide 6 and tube 20, and generate the tension forces in the web folding over its side margins as it runs along the guide 6, obliquely to the tube 20. It is possible to employ traction bands having a longer contact area with the web, instead of the drive rollers.

Below the drive rollers are a pair of driven heated rollers 26 which seal the edges of the web together to form a projecting welded fin, the web thus becoming a closed tube. As the fin is released from the nip of the sealing rollers it is acted upon by a fixed plough 27 that projects into the gap between the lower regions of the rollers. The plough deflects the fin towards the tubular web and immediately below the plough is an unheated roller 28 near the lower end of the forming tube which presses the still hot welded fin against the tubular web to which it is tack sealed by its own heat.

Figure 3:
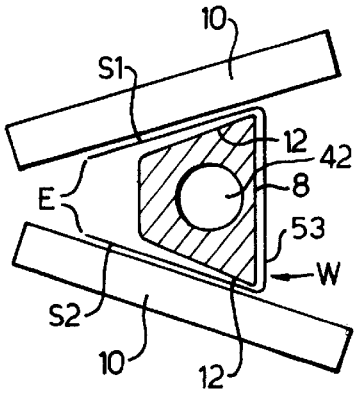

At the point of exit from the guide 6, as shown in FIG. 3, the web W has a three-sided open cross-sectional form with the opposite side margins S1,S2 inclined towards each other but their free edges E remaining spaced apart. The widths of the central portion S3 and each of the side margins S1,S2 of the web are substantially equal at this stage. When the web comes onto the tube, the edges E are brought together progressively by the fixed guides 22 as the cross-sectional form of the web is moulded to that of the tube due to the tension created in the web by the traction forces drawing it downwards.

The web thus leaves the form-fill tube as a closed tube and is then drawn through sealing rotors 32 which, in known manner, produce transverse seals to divide the web interior into separate compartments and sever the web at the seals to form a series of individual packets.

The guide 6 also comprises a chute 42 for the delivery of filling material into the forming tube 20 and a junction piece 42*a* provides an essentially sealed connection between the chute and the tube. In this example, the maintenance of a reservoir of the material in the chute is controlled by a sliding gate valve 44 operated by an actuator 46. The material is dispensed in discrete doses from the forming tube in synchronism with the transverse sealing operation by a valve mechanism comprising a reciprocating plunger 48.

That is to say, immediately after each transverse seal is made the plunger 48 descends from the raised position shown in FIG. 3 into outlet nozzle 50 of the tube to drive a dose of filling material into the tubular web. The dosing of the material into the tube and the formation of the individual packets from the tube can be carried out generally in the manner described in PCT application WO95/01907, for example, so need not be described further here. The valve plunger is driven by a straight-line mechanism 52 that is further described below.

Figure 4:
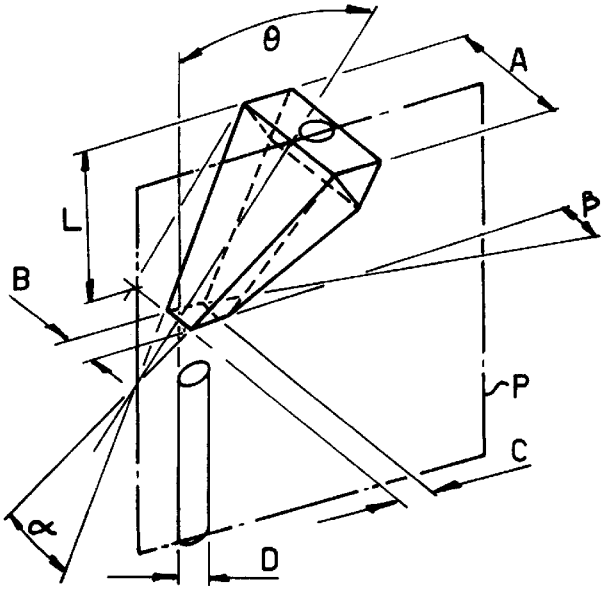

FIG. 4 illustrates some features of the geometry of the guide plate 6 in the present example. The inclination of the guide plate to the form fill tube is indicated by the angle θ and the broken line Figure P indicates a common plane of symmetry of the guide plate and tube. The taper of the guide plate is given by the angle α. The angle between the side margins of the web at exit from the guide (as shown in FIG. 3) is given by the angle β and the throw or extent of the side margins at exit is indicated by the dimension C. The width of the web is indicated by the dimension A while the dimension B is the width of the bottom of the guide plate, which is chosen to be slightly larger than the diameter D of the forming tube 20. The height of the guide plate, axially of the tube 20, is indicated by the dimension L.

The web is drawn over the guide roll 4, along the guide 6 and the forming tube 20 by the traction force of the drive rollers 24. The distribution of the tension forces in the web from the traction force of the rollers 24 is influenced by the angle θ of the guide 6 which is 15° in the illustrated example. As the angle θ increases the friction force experienced by the web increases, and on that account the angle θ is preferably no greater than about 30°. For typical paper/thermoplastic composite materials used for heat-sealed tea bags the risk of rupture of the web becomes too great if the angle is significantly more than 35°. In the illustrated example in which the guide 6 also incorporates the filling material chute 42, it is necessary in any case to maintain a large inclination to the horizontal to ensure that a sufficient rate of flow of the material can be maintained.

The angle θ can be reduced below 15° but the guide 6 must then be lengthened to allow the side margins to be folded over to the extent that gives the same exit profile to the web. If an angle less than about 8° is chosen the required length of the guide plate 6 can become excessive.

Preferably, the relationship between the width B and the diameter D is given by $$D<B<1.3C$$

In the preferred example illustrated B=1.15D. Also, the angle β between the side margins of the web at the exit from the guide 6 is preferably in the range of 12° to 40°, in the illustrated example 20°. These relationships are able to match the trapezoidal-like section of the web at exit from guide 6 to the circular section to which it is transformed on the forming tube.

The angle of taper a of the guide 6 is preferably chosen so as to match the path lengths of the web over the guide at different positions along its width. Eg. in the passage of the web over the guide the path length along the centre of the web should be approximately the same as the path length of each side edge of the web as the side margins are progressively folded over. In the illustrated example, α is 24°.

The dimensions and relationships between the parts are chosen so as to provide that the pattern of forces generated in the web by the traction of the rollers 24 is effective in folding up the side margins of the web in a controlled manner. The auxiliary guides 10 and the fixed guides 22 on the tube also play their part in controlling the folding over the outer margins and help to minimise any wrinkling of the web as this takes place, although it is also possible to omit the guides 10 or to operate with only one of these guides. One or both guides 10 may be omitted, for example, if it is required to leave a greater part of the width of the outer face of the web out of contact with any tube-forming elements.

The drive rollers 24 should grip the edges of the web without slippage in order to maintain the tracking of the web along the form-fill tube 20, ie. to ensure that the web remains centralised so that essentially constant width portions of the web edges are gripped and are sealed together by the heated rollers. To this end, the peripheral faces of the rollers are roughened.

It is also found to help reduce unwanted stresses in the web along the form-fill tube 20 if the axes of the rollers 24 and 26 do not extend normal to the tube axis but are tilted at a small angle so that the roller bottom edges run closer to the tube than their top edges. The angle of tilt is preferably between 0.5° and 2°. This inclination produces a transverse force component on the web acting towards the tube 20.

To maintain tension in the web, the rollers 24 are driven to draw the web through them at a slightly faster rate than the input feed (not shown) upstream of the entry roll 2. The heated sealing rollers are also driven so that their peripheries run at a small degree of overspeed relative to the peripheral speed of the drive rollers to ensure tension is maintained in the web as the side edges are sealed. Similarly, the pressing roller 28 may be driven at a slightly greater peripheral speed than the sealing rollers.

A feature of the illustrated apparatus as compared with many conventional types of form-fill apparatus is that from the entry roll 2 to the completion of the tube a substantial part of that surface that forms the outer face of the tubular web is kept out of contact from the apparatus. Together with the avoidance of any very sharp changes of direction, maintaining a face of the web free from any rubbing contact makes it practical for that face of the web to carry attachments while going through the form-fill process. In particular, arrangements of handling tags and threads such as are known for infusion packets can be attached to that face of the web before the packets are formed so permitting simpler and faster production of tagged packets.

Until the web reaches the form-fill tube 20 its central portion is maintained with a planar cross-section and it will generally be convenient to locate attachments such as tag-thread arrangements on that portion. If the precaution is required to avoid disturbing the attachments, the form-fill tube can itself have a cross-section with a flat in that part of its periphery coincident with the attachments.

Figure 8:
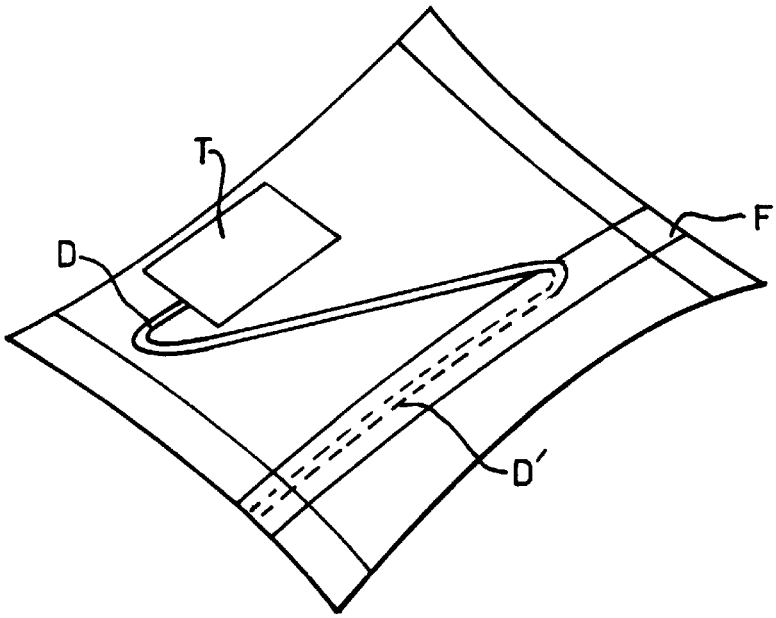

In the illustrated example of the invention the web carries an arrangement of tags and thread (as shown in FIG. 8) in which the thread is laid along the web in a serpentine pattern that extends across a substantial part of the width of the outer face of the web on the form-fill tube and the tags are attached to the thread in a region diametrically opposite the pairs of rollers 24,26. Portions of the thread extend close to the welded fin of the web and these can be held between the fin and the tubular web when the fin is tacked to the main body of the web by the roller 28. In this way, the thread is held in place to avoid entanglement when the packets are stored in a container before use. Also, pressing the raised welded fin flat against the tubular web assists the completion of the transverse seals that follow the formation of the tubular web.

Figure 2:
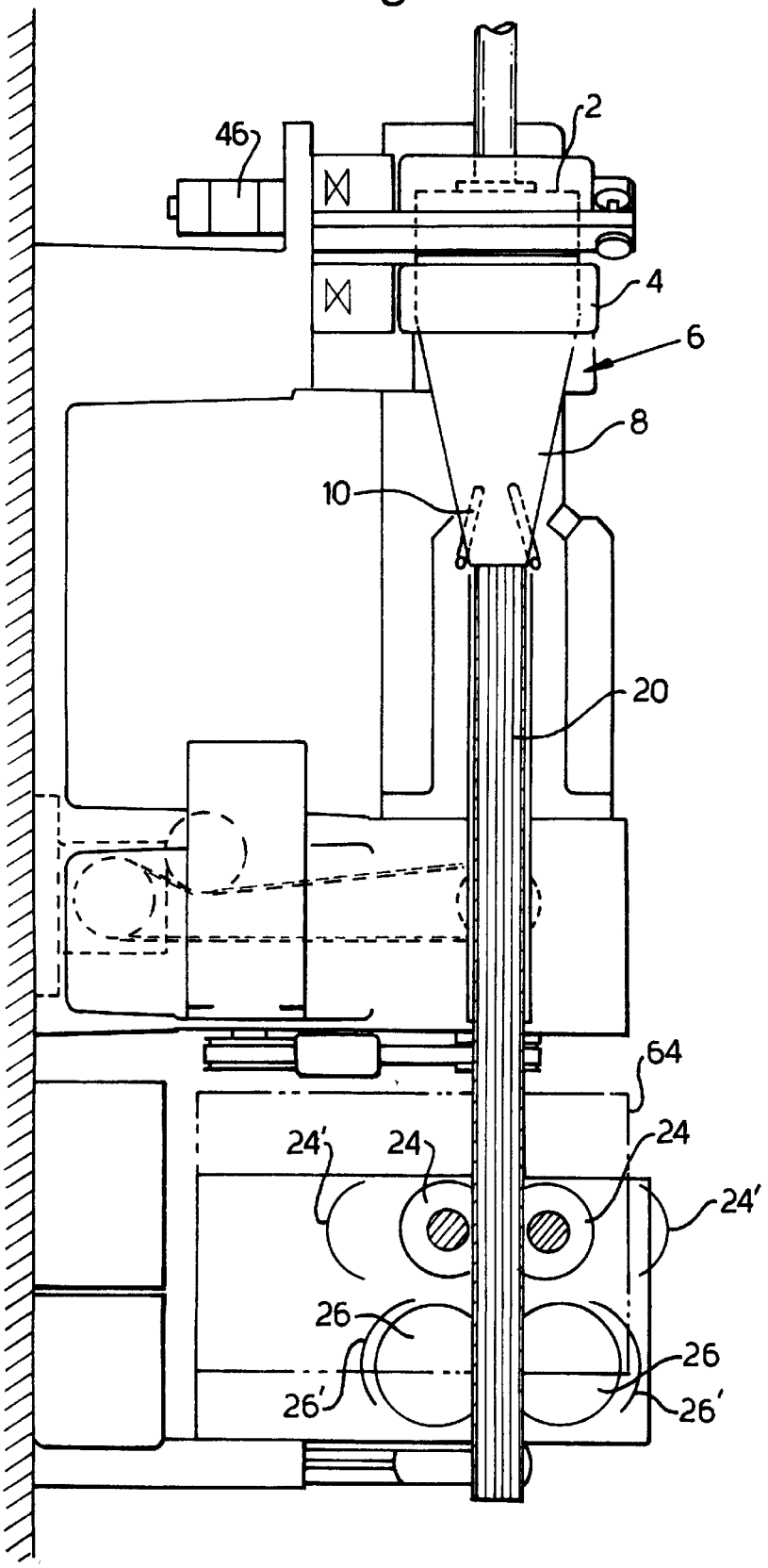
Figure 5:
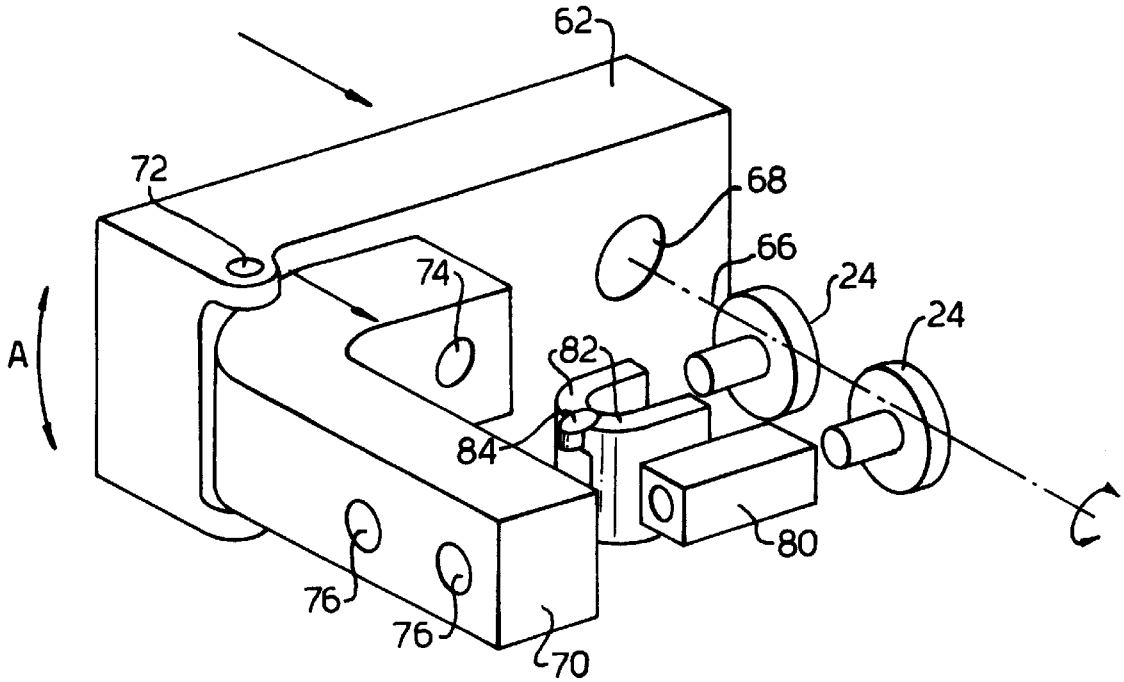

The mountings of the drive rollers are illustrated schematically in FIG. 5. A gearbox 62 is supported on a fixed frame 64 (FIG. 2) to be pivotable in the arrowed direction A about an axis 66 that intersects the rotary axes of both drive rollers 24 at their front faces. A drive input shaft 68 to the gearbox is also located on the pivot axis so as to be unaffected by any tilt of the gearbox about that axis. To the rear of the gearbox 62 a carrier 70 is mounted on it through a vertical hinge 72. The drive is transmitted from the gearbox 62 to an intermediate shaft 74 in the carrier that engages with the gearbox drive when the carrier is in the position shown. Within the carrier 70, the drive is transmitted to two parallel shafts 76 which are thereby driven synchronously with each other. Transmission shafts 78 (FIG. 1) comprising universal couplings (not shown) connect the shafts 76 to the respective drive rollers 24 which are mounted in separate bearing blocks 80. The bearing blocks are fixed to respective arms 82 which are supported on the carrier 70 through a common fixed pivot 84. The rollers can therefore be swung apart about the pivot 84, the universal couplings of the shafts 78 accommodating such movement relative to the carrier 70.

The heat sealing rollers 26 are mounted and driven through gearbox 92 (FIG. 1) in a similar manner to the drive rollers, so further illustration is not necessary.

The pivoting movement of the gearbox 62,92 in each case adjusts the tilt of the rollers relative to the tube 20 referred to above. The pivoting movement of the bearing blocks 80 allows the rollers to be separated, as will be required for example when first threading the web through the apparatus: the maximum extent of their separation is indicated in outline in FIG. 2 where the displaced roller positions are referenced 24' and 26' respectively. The carrier hinge 72 allows the pairs of rollers to be swung away from the form-fill tube 20 after they have been separated, to give easier access to the tube. It will be noted that the respective mountings of the drive and sealing rollers are located on opposite sides of the form-fill tube for reasons of space. The tube is thus located between the drive roller bearing blocks in operation and that is why the drive rollers 24 are required to have a greater separation.

Figure 6:
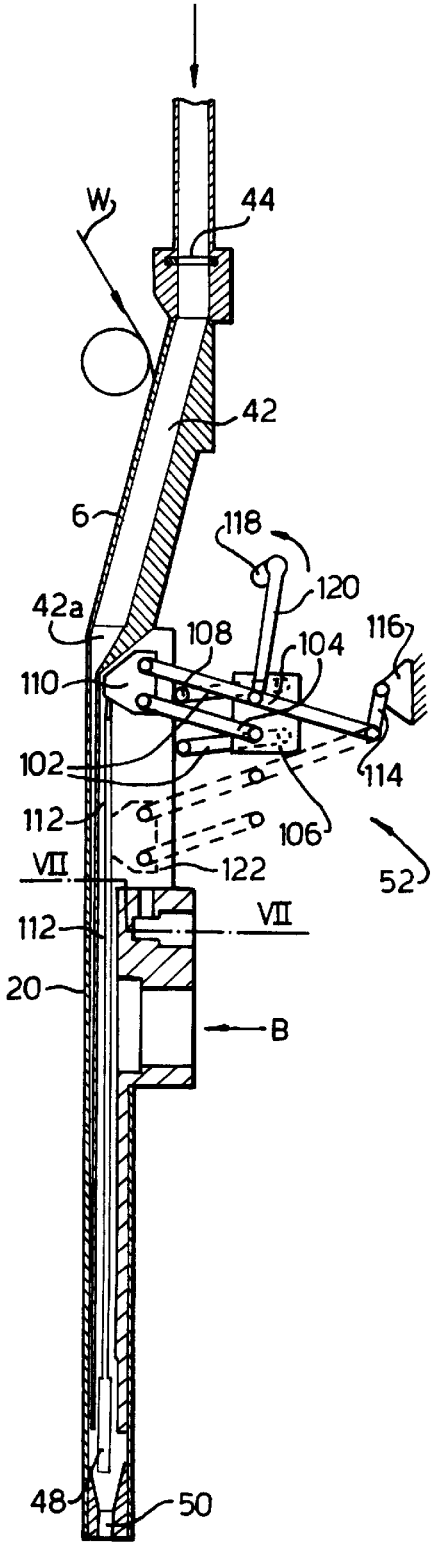

The drive of the dosing plunger is shown in FIG. 6. It comprises parallel pairs of links 102,104 connected through an intermediate block 106, the first pair 102 having fixed pivots 108, the other pair 104 being pivoted to a plate 110 fixed to valve rod 112 carrying the plunger 42 and one link of that second pair having its opposite end restrained by a pivot link 114 attached to a fixed support 116. The mechanism is driven by a rotary crank 118 to which it is linked by a connecting rod 120 and constrains the plate 110 to reciprocate in a straight line. It will be noted that the mechanism, and in particular its pivot links, is offset laterally away from the interior of the forming tube interior. There is therefore no risk of lubricating fluids contaminating the dosing material in the tube.

In the upper region of the forming tube 20, above the guides 22 which bring the edges of the web together, an opening 122 in the side of the tube 20 provides access for the transmission of drives through the gap between the web edges to the tube interior. In particular, the valve rectiinear drive mechanism 52 is connected to the valve rod 112 in this region. A further mechanism, not shown in such detail, extends into the tube below the valve drive mechanism, for operating spreader fingers (not shown) that act to flatten the tubular web below the forming tube immediately before each transverse seal is made by the rotors 32. Such mechanisms are known, eg. from WO95/01907, so will not be further described here. In the sectional view of FIG. 7, however, in which part of the drive input to the spreader finger mechanism appears, it is shown how a channel-form spine 124 is secured to the opening 122 above the guides 22, and supports an input shaft 126 of the spreader finger drive mechanism mounted in rotary bearings 128. The input shaft 126 drives an intermediate shaft 130 through bevel gearing 132 and the intermediate shaft 130 transmits the drive to vertical drive shaft 134 of the mechanism within the confines of the forming tube.

Figure 7:
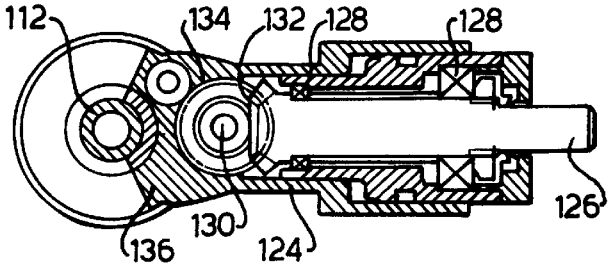

In addition to the manner in which the drive is transmitted laterally into the forming tube, FIG. 7 is notable for the manner in which the intermediate and drive shafts 130,134 are shown mounted in a sector shaped member 13G, which may be integral with the spine 124, that effectively seals the opening 122 in the forming tube to prevent the escape of dosing material being fed into the tube from the chute 42.

FIG. 6 also shows a tube or sheath 134 surrounding the plunger, which is axially adjustable to control the dosage rate, as described in co-pending patent application EP 96308141.9 filed 11 Nov. 1996, and can also be employed to guide the plunger concentrically in the tube. Access for a drive input to displace the sleeve axially is also located in the spine 124, as indicated by the arrow B below the drive input to the spreader finger mechanism.

An example of a tea bag formed by the illustrated apparatus is shown in FIG. 8. The envelope of the packet is formed by the heat sealable web W drawn through the apparatus with a series of tags T already tack-welded in place and attaching threads D placed in the pattern shown and secured at opposite ends to the tags and the web.

The end portion D' of the thread furthermost from the tag T is located close to one side edge of the web, so that when welded fin F is laid onto the main body of the web by the plough 27 and roller 28 that portion of the thread is held under the fin. Because additional heating is not supplied, only a weak tacking heat seal is produced which allows the thread to be freed from the fin when the tea bag is to be used.

Although a preferred form of the invention has been illustrated and described, it will be understood that many modifications may be made within the scope of the invention. For example, it is possible to replace the separate pairs of drive rollers and sealing rollers with a single pair of rollers performing both functions, as will be understood without further illustration although the unheated drive rollers are better able to apply the required tension to the web without slippage. Also other rolling elements such as tractor bands can be employed in place of rollers. As another instance, although the inclined guide preceding the form-fill tube is shown as a plate, it can be formed by a pair of rails, especially if an alternative supply conduit is provided for the filling material.

It should be noted that the tube forming process described does not rely on the web having inherent stiffness that will help it to hold a generally circular cross-section unsupported. It can therefore be operated with the relatively thin and limp permeable, non-woven web materials used for infusion packets. Nor does the process require the tubular web to be supported internally by the filling material, as is often necessary in form-fill processes for packaging liquids. It can therefore be used where the packet contents occupy only a small part of the potential volume, as is commonly the case with dry infusible materials.

What is claimed is:

1. Apparatus for shaping a travelling web into a tubular form in a form-fill process, comprising:

a fixed guide for the web, said guide defining a track for guidance of the web, said track having a leading end in a direction of web travel and an exit end spaced from said leading end in the travel direction, the track tapering in said travel direction from the leading end of the track, whereby the track has a width that is narrower at the exit end, said web comprising a central portion and side marginal portions to opposite sides of the central portion, the guide track being engaged with said central portion from said leading end to said exit end, the side marginal portions of the web overlapping the tapering guide track towards said exit end the web leaving said exit end in an open tubular form, a forming tube having an external circumference larger than said width of the track exit end and providing a shaping surface for the web following the guide track in the direction of web travel, the web being given a tubular form on said surface and opposite side edges of the web being brought together, said forming tube having a longitudinal axis directed obliquely to the guide track and said axis extending to intersect the guide track, means for placing the web under tension comprising traction elements adjacent the forming tube drawing the web in its travel direction along the guide track and forming tube, said side edges of the web being gripped by said traction elements as the web travels along the tube.

2. Apparatus according to claim 1 comprising gathering means disposed upstream of said traction elements for bringing opposed edges of said side margins together as the web travels along the forming tube.

3. Apparatus according to claim 2 wherein the gathering means for bringing together said edges of the web side margins comprise fixed guide elements at a location along the forming tube upstream of said traction elements and between which said side edges are drawn.

4. Apparatus according to claim 1 wherein said traction elements are arranged also to act as sealing elements for sealing said web edges together.

5. Apparatus according to claim 4 comprising presser means between said sealing means and an exit end of the forming tube for folding the sealed edges against the tubular form of the web and attaching said folded edges to said tubular form.

6. Apparatus according to claim 1 having a guiding means at opposite sides of the fixed guide for the folded-over side margins of the web.

7. Apparatus according to claim 1 wherein sealing means are arranged downstream of said traction elements for engagement of said edges of the web as the web travels along the forming tube to seal said edges together.

8. Apparatus according to claim 7 comprising presser means between said sealing means and an exit end of the forming tube for folding the sealed edges against the tubular form of the web and attaching said folded edges to said main tubular form.

9. Apparatus according to claim 1 wherein the angle of obliquity between a projection of the forming tube axis above the guide track and a central path along said guide track is not substantially more than 35°.

10. Apparatus according to claim 9 wherein the angle of obliquity is between 8° and 30°.

11. Apparatus according to claim 10 wherein the angle of obliquity is substantially 15°.

12. Apparatus according to claim 1 wherein the traction elements are inclined relative to the forming tube to apply a traction force to the tube having a major component acting in the direction of said tube axis and a minor component acting transversely towards the tube.

13. Apparatus according to claim 1 wherein a dosing valve is disposed within the forming tube and a dosing valve mechanism for operating said valve projects laterally into the forming tube at a region of the tube adjacent said guide and at which the web has said open tubular form.

14. Apparatus according to claim 13 wherein said dosing valve mechanism comprises a linkage for generating rectilinear motion of the dosing valve within the forming tube in the direction of the tube axis, said linkage being connected to said valve at a region laterally spaced from the tube interior.

15. Apparatus for shaping a web into a tubular form in a flow-fill process, comprising:

a guide along which the web travels and defining a track for the web that tapers in the direction of said travel, the web having, transverse to the direction of travel, a central region and respective side margins to opposite sides of said central region, said margins having edges forming opposite side edges of the web, guiding means disposed laterally of the guide for at least one folded-over side margin of the web overlapping the guide, a forming tube downstream of the guide in the direction of web travel for receiving said web in an open tubular form in which the edges of said side margins remain spaced apart, the axis of the tube being oblique to the guide and extending to intersect said tapering track, gathering means for bringing together the side edges of the web at a first location along the forming tube, and means for joining the web side edges together at a second location along the forming tube downstream of the first location, said joining means comprising opposed rolling elements between which the web edges are gripped, said rolling elements being driven to draw the web along the guide and past said first location on the forming tube to said second location.

16. Apparatus according to claim 15 having said guiding means at opposite sides of said guide for the respective web side margins.

17. Apparatus according to claim 15 wherein the angle of obliquity between a projection of the forming tube axis above the guide track and a central path along said guide track is not substantially more than 35°.

18. Apparatus according to claim 17 wherein the angle of obliquity is between 8° and 30°.

19. Apparatus according to claim 18 wherein the angle of obliquity is substantially 15°.

20. Apparatus according to claim 17 wherein a dosing valve is disposed within the forming tube and a dosing valve mechanism for operating said valve projects laterally into the forming tube at a region of the tube adjacent said guide and at which the web has said open tubular form.

21. Apparatus according to claim 15 wherein the traction elements are inclined relative to the forming tube to apply a traction force to the tube having a major component acting in the direction of said tube axis and a minor component acting transversely towards the tube.

22. Apparatus according to claim 21 wherein said dosing valve mechanism comprises a linkage for generating rectilinear motion of the dosing valve within the forming tube in the direction of the tube axis, said linkage being connected to said valve at a region laterally spaced from the tube interior.

23. Apparatus for shaping a travelling web into a tubular form in a form-fill process, comprising:

a fixed guide for the web, said guide defining a track for the web tapering in the direction of web travel to a width less than the width of the web, opposite side margins of the web thereby overlapping said track as it tapers, a forming tube downstream of the guide in the direction of web travel, said tube having an external peripheral wall along which the web travels after leaving said track, and a longitudinal axis oblique to the guide, said axis extending to intersect the track for the web on the guide, traction means intermediate the length of the former tube for drawing the web along the guide and forming tube and for causing the opposite side margins of the web overlapping the guide to fold over and converge towards each other as the web travels along the tapering guide, said traction means comprising opposed rolling elements for gripping between them opposite edges of said side margins together and for sealing said edges to each other so as to form the web into a closed tube with a longitudinal sealed seam, means for laying said seam against an external wall of said tube and attaching it thereto.

24. Apparatus according to claim 23 wherein said opposed rolling elements are arranged both to draw the web along the guide and forming tube and to seal said web edges together.

25. Apparatus according to claim 23 wherein a first plurality of said opposed rolling elements draw the web along the guide and forming tube, a further plurality of opposed rolling elements being arranged at a station along the forming tube downstream of said first plurality of elements are disposed for sealing said web edges together.

26. Apparatus according to claim 23 wherein said opposed rolling elements drawing the web along the guide and forming tube lie in a plane inclined to the forming tube so as to generate forces urging said web edges towards said tube.

27. Apparatus according to claim 23 wherein the angle of obliquity between a projection of the forming tube axis above the guide track and a central path along said guide track is not substantially more than 35°.

28. Apparatus according to claim 27 wherein the angle of obliquity is between 8° and 30°.

29. Apparatus according to claim 28 wherein the angle of obliquity is substantially 15°.

30. Apparatus according to claim 23 wherein a dosing valve is disposed within the forming tube and a dosing valve mechanism for operating said valve projects laterally into the forming tube at a region of the tube adjacent said guide.

31. Apparatus according to claim 30 wherein said dosing valve mechanism comprises a linkage for generating rectilinear motion of the dosing valve within the forming tube in the direction of the tube axis, said linkage being connected to said valve at a region laterally spaced from the tube interior.

32. A method of shaping a travelling web into a tubular form in a vertical form-fill process, comprising the steps of:

(i) drawing the web along a guide defining a track that tapers in the direction of web movement, (ii) progressively folding over lateral margins of the web overlapping the track as the web travels along the guide, so forming the web into an open tubular shape in which, opposite side edges of the web remain spaced apart, (iii) drawing the web in said open tubular shape onto a forming tube having a longitudinal axis extending obliquely to the guide, (iv) bringing together the side edges of the web as it travels along the forming tube to close said tubular shape of the web, (v) gripping said side edges together between traction elements to apply a tension to the web for drawing it along said track and tube and for folding over said lateral margins of the web, and (vi) sealing said side edges together while the web is travelling along the forming tube in said closed tubular shape.

33. Method according to claim 32 wherein the edges of the web are also urged laterally towards the forming tube by the traction elements.

34. Method according to claim 32 wherein the path of the web along the guide track is directed obliquely to the path of the web along the forming tube by an angle not substantially more than 35°.

35. Method according to claim 34 wherein the angle of obliquity is between 8° and 30°.

36. Method according to claim 35 wherein the angle of obliquity is substantially 15°.

37. Method according to claim 32 wherein said folding over of the lateral margins of the web overlapping said guide is assisted by applying guiding elements to said lateral margins.

38. Method according to claim 32 wherein the side edges of the web are brought together after being drawn onto the forming tube and before arriving at said traction elements.

39. Method according to claim 32 wherein the open tubular shape of the web as it leaves the guide has three substantially equal sides.

40. Method according to claim 32 wherein attachments are placed on a face of the web before the web is drawn along the guide, said face being directed away from the guide and the former tube while the web is drawn thereal-ong.

41. Apparatus for shaping a travelling web into a tubular form in a form-fill process, comprising:

(i) a fixed guide defining a track for the web, the track having leading and trailing ends that are mutually remote in the direction of web travel, the track tapering in said direction whereby the exit end of the track is narrower than said leading end, (ii) a forming tube extending beyond said track in the direction of web travel for receiving the web after the web has left said exit end of the guide track, (iii) the forming tube having a longitudinal axis parallel to the direction of web travel along said tube and the guide track extending obliquely to said axis, continuation of said axis beyond the forming tube intersecting said guide track between said leading and exit ends, (iv) traction elements intermediate the extent of the forming tube for drawing the web in a state of tension along the guide track and forming tube in its direction of travel, said traction elements gripping opposite lateral edges of the web together as they draw the web along the forming tube, (v) said tapering track towards the exit end supporting only a central portion of the width of the web, side marginal portions of the web to each side of said central portion overlapping the guide track, said tension in the web folding said side margins over towards the forming tube and giving the web an open tubular form as it leaves the guide track.

42. Apparatus for shaping a travelling web into a tubular form in a form-fill process, comprising:

a fixed guide for the web, said guide defining a downwardly tapering track for the travel of the web, said track thereby having a wider upper leading region and a narrower lower exit region, a forming tube below said guide track for receiving the web from said track and having an outer circumference around which the web is formed into a tubular shape, said track exit region having a width substantially less than said circumference of the forming tube, whereby side marginal portions of the web overlap said exit end, the forming tube having a longitudinal axis oblique to the guide track, an extension of said axis above the forming tube intersecting said track and said exit region of the track being laterally offset from said axis, traction means adjacent the forming tube for engaging opposite side edges of the web to draw the web along said guide track and forming tube under tension, said traction means being laterally offset from the tube axis in the opposite direction to said track exit region whereby the marginal portions of the web overlapping said exit region are folded over to give the web an open tubular form as it leaves the track.

43. Apparatus for shaping a travelling web into a tubular form in a form-fill process, said web comprising opposite first and second faces extending between side edges of the web, the apparatus comprising:

a fixed guide for the web, said guide having mutually spaced entry and exit regions and defining a downwardly tapering track between said regions for sliding engagement with the first face of the web, the track entry region being wider than the exit region and the track tapering therebetween, said exit region having a width narrower than said faces of the web, side margins of the web thereby overlapping the track at said exit region, a forming tube below said guide track for sliding engagement with said first face of the web, traction elements adjacent the forming tube and intermediate its length for gripping together said side edges of the web and drawing the web under tension in its travel direction along said guide track and forming tube, the forming tube having a longitudinal axis directed obliquely to the guide track and above the forming tube said axis extending to intersect the guide track, said side margins of the web overlapping said narrower exit end of the track being folded over by the web tension to give the web an open tubular form as it leaves the guide track and runs onto the forming tube, shaping elements shaping said open tubular form into a closed tubular form around the forming tube as the web travels along the forming tube upstream of said traction elements.

* * * * *